US006573924B2

(12) United States Patent
Miyagawa et al.

(10) Patent No.: US 6,573,924 B2
(45) Date of Patent: Jun. 3, 2003

(54) EXPOSURE HEAD AND IMAGE RECORDING APPARATUS

(75) Inventors: Ichiro Miyagawa, Kanagawa (JP); Mitsuru Sawano, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 12 days.

(21) Appl. No.: 09/987,985

(22) Filed: Nov. 16, 2001

(65) Prior Publication Data

US 2002/0060732 A1 May 23, 2002

(30) Foreign Application Priority Data

Nov. 17, 2000 (JP) ..... 2000-351147

(51) Int. Cl.[7] ..... B41J 2/47
(52) U.S. Cl. ..... 347/239; 347/255
(58) Field of Search ..... 347/238, 239, 347/241, 255, 256; 372/44, 55, 54, 64; 385/31, 43, 133; 359/34

(56) References Cited

U.S. PATENT DOCUMENTS 4,713,821 A * 12/1987 Bradford et al. ..... 372/44
5,228,049 A * 7/1993 Paoli ..... 372/50

FOREIGN PATENT DOCUMENTS

JP 10-50968 * 2/1998

* cited by examiner

*Primary Examiner*—Hai Pham
(74) *Attorney, Agent, or Firm*—Sughrue Mion, PLLC

(57) ABSTRACT

The exposure head includes at least one light source of a broad area type, an optical waveguide gradually broadening in a broad area direction of the light source toward a traveling direction of light emitted from the light source, a member collimating the light traveling in a perpendicular direction to the broad area direction, the light being emitted from the optical waveguide and a light modulating device including a plurality of modulation units arrayed in the broad area direction. The image recording apparatus includes the above exposure head an optical system for focusing on a predetermined position the light emitted from the exposure head and a scanner for allowing the exposure head and a photosensitive material to move relatively, while regulating the photosensitive material at the predetermined position.

6 Claims, 4 Drawing Sheets

EXPOSURE HEAD AND IMAGE RECORDING APPARATUS

BACKGROUND OF THE INVENTION

The present invention belongs to a technical field of image recording by scanning exposure. More specifically, the present invention relates to an exposure head of a low-cost and compact-sized type capable of realizing multi-channel image exposure, and to an image recording apparatus using the exposure head.

Exposure apparatuses, which perform scanning exposure for photosensitive materials such as silver halide photographic photosensitive materials and electrophotographic photoreceptors with recording light modulated in accordance with images to be recorded, are used in various kinds of printers and copiers.

With respect to such an exposure apparatus, the one has been primarily used, which uses so-called light beam scanning exposure in the following manner. Light beams modulated in accordance with an image to be recorded are deflected in a main scanning direction, and, at the same time, a photosensitive material and the light beams are moved relatively to each other in an auxiliary scanning direction perpendicular to the main scanning direction, whereby the photosensitive material is scan-exposed two-dimensionally by the light beams for image recording.

With the progress of technology in recent years, such a light beam scanning exposure has made it possible to record high quality images at a high-speed. However, the image exposure by light beam scanning shows a limitation to a realization of higher speed image exposure and higher resolution. Particularly, regarding large images often used in a printing field or the like, it is considered to be difficult to record a high quality image at a higher speed by use of the image exposure by the light beam scanning.

As a method of solving the foregoing problems and enabling a high-speed and high-quality image recording, multibeam image exposure has been known, in which a plurality of light beams simultaneously expose a photosensitive material.

As methods of realizing the multibeam exposure, the following methods have been known: a method using light sources such as laser diodes (LD) corresponding to light beams in the number, which perform an exposure; a method which splits a light beam into a plurality of light beams by use of an optical system and performs an exposure by use of a light modulator such as an acoustooptic modulator (AOM) for each of the light beams; and a method which allows light beams emitted from a light source to be incident into a spatial light modulator such as a liquid crystal shutter array by use of an optical system, and to be focused on an exposure surface as the plurality of light beams individually modulated in order to form an image.

However, in the method of using the light sources corresponding to the light beams in the number, though a sufficient amount (or intensity) of light can be obtained for each light beam, costs are required in various points, such as a plurality of light sources; an optical system for making the light beam emitted from each light source be incident into and focused on a predetermined position in order to form an image; and unitization thereof.

In the method of split the light beam, the number of split light beams, that is, the number of light beams available is limited in terms of an amount of light (or light intensity).

Moreover, since the optical system is required for making the plurality of light beams incident into the light modulator, this method is also expensive.

In the method of using the spatial light modulator, since a transverse multimode light source such as a broad area LD is available, a sufficient amount (or intensity) of light can be obtained for each light beam. However, though the optical system and the like are required for making the light beams emitted from the light source incident into all modulation elements of the spatial light modulator, this method is also expensive.

In addition, any method described above cannot prevent the increase in size of the apparatus for obtaining multi-beams (a plurality of light beams). The improvement is desired in this point.

SUMMARY OF THE INVENTION

The objects of the present invention are to solve the foregoing problems in the conventional art. Specifically, the first object of the present invention is to provide an exposure head of a multi-channel type capable of performing the multi-channel exposure with less limitations in terms of the amount (or intensity) of light by use of light beams of sufficient light amount (intensity) for all channels, and capable of realizing a cost and size reduction of the apparatus.

Further, the second object of the present invention is to provide an image recording apparatus using the above exposure head.

In order to attain the first object described above, the first aspect of the present invention provides an exposure head comprising: at least one light source of a broad area type; an optical waveguide gradually broadening in a broad area direction of the at least one light source toward a traveling direction of light emitted from the at least one light source; a member collimating the light traveling in a perpendicular direction to the broad area direction, the light being emitted from the optical waveguide; and a light modulating device including a plurality of modulation units arrayed in the broad area direction.

In order to attain the second object described above, the second aspect of the prevent invention provides an image recording apparatus, comprising: an exposure head including; at least one light source of a broad area type; an optical waveguide gradually broadening in a broad area direction of the at least one light source toward a traveling direction of light emitted from the at least one light source; a member collimating the light traveling in a perpendicular direction to the broad area direction, the light being emitted from the optical waveguide; and a light modulating device including a plurality of modulation units arrayed in the broad area direction; an optical system for focusing on a predetermined position the light emitted from the exposure head; and a scanner for allowing the exposure head and a photosensitive material to move relatively, while regulating the photosensitive material at the predetermined position.

Preferably, the optical waveguide has one of a tapered shape and a parabolic shape.

Preferably, each of the modulation units includes a transparent conductive material disposed so as to be opposite to a boundary surface of the optical waveguide with a space therebetween and a unit for bringing the conductive material into contact with the boundary surface of the optical waveguide by use of static electricity.

BRIEF DESCRIPTION OF THE DRAWINGS

FIGS. 1A and 1C are plan views; and

FIG. 1B is a side view.

FIG. 2A is a plan view; and

FIG. 2B is a side view.

FIG. 3A is a plan view;

FIG. 3B is a side view;

FIG. 3C is a partial perspective view; and

FIG. 3D is a partial side view.

FIG. 5A is a plan view;

FIG. 5B is a side view;

FIG. 5C is a plan view of an optical system of the image recording apparatus; and FIG. 5D is a side view of the optical system.

DETAILED DESCRIPTION OF THE PREFERRED EMBODIMENTS

Description will be made in detail on an exposure head and an image recording apparatus of the present invention in accordance with preferred embodiments shown in the accompanying drawings below.

Figure 1A:
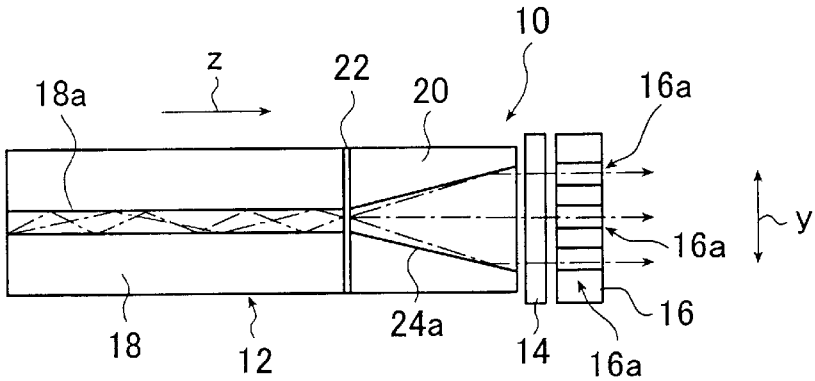
FIGS. 1A to 1C are schematic views showing an embodiment of an exposure head of the present invention.
Figure 1B:
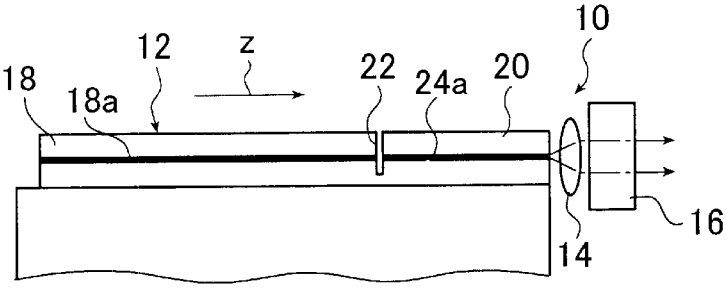
Figure 1C:
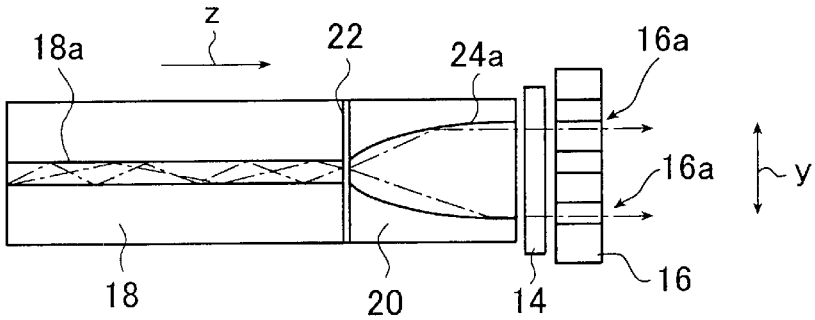

FIGS. 1A to 1C show schematic views of an embodiment of the exposure head of the present invention.

Herein, FIG. 1A is a view (hereinafter, referred to as a plan view) of the exposure head viewed in a perpendicular direction to a broadening direction (broad area direction) of light emitted from a light source. FIG. 1B is a view (hereinafter, referred to as a side view) of the exposure head viewed in the broad area direction, which is an array direction of spatial modulation elements (scanning direction described later).

As shown in FIGS. 1A to 1C, an exposure head 10 includes a light source element 12, a cylindrical lens 14, and a spatial light modulator (SLM) 16.

The light source element 12 is unitedly constituted by a broad area laser diode (BLD) element unit 18 and an optical waveguide unit 20. Both units are separated by a notch 22 from each other.

The BLD element unit 18 has a constitution similar to the well known various kinds of semiconductor lasers of a broad area type (BLD), such as a constitution having an active layer 18*a*, in which a plurality of emitters emitting laser beams (single-dashed lines) are arrayed in one direction. The BLD element unit 18 emits laser light broadening in one direction from the notch 22, which is the broad area direction (arrow y direction in the drawing). In the abovementioned embodiment, the array direction of emitters is the broad area direction.

In the light source element 12 of the embodiment in the drawings, in which the BLD element unit 18 and the optical waveguide unit 20 are united with each other, a reflection plane is defined by forming the notch 22 therebetween, thus realizing a resonance structure in the BLD element unit 18.

Note that, in the present invention, the broad area light source is not limited to the foregoing BLD type, and various kinds of laser light sources of the broad area type can be utilized, which emit laser light broadening in one direction.

The optical waveguide unit 20 includes an optical waveguide 24*a* gradually broadening in the broad area direction toward a traveling direction of the laser light emitted by the BLD element unit 18. The traveling direction is a direction indicated by an arrow z in the drawing (hereinafter, referred to as a traveling direction), to which the active layer 18*a* extends. Note that as far as a material has an adequate transmission factor in accordance with a wavelength of the laser light, various kinds of materials which allow corresponding laser light to pass (propagate) therethrough are available as the optical waveguide 24*a*. For example, various kinds of silicon nitride or the like is enumerated.

In the embodiment shown in the drawing, the optical waveguide 24*a* is a tapered thin film waveguide broadening in the broad area direction toward the traveling direction.

A light incident plane of the optical waveguide 24*a* is positioned so as to face the active layer 18*a* at the notch 22 formed in the light source element 12, and allows the laser light emitted from the BLD element unit 18 (the active layer 18*a*) to be incident thereinto and to be propagated therefrom.

Herein, the optical waveguide 24*a* is a tapered waveguide broadening in the broad area direction as described above. Accordingly, a component of the laser light emitted from the BLD element unit 18, which travels obliquely to the traveling direction, is reflected on the end surface of the optical waveguide 24*a* in the broad area direction as shown in FIG. 1A, and a traveling direction of the component is corrected to a direction substantially perpendicular to the broad area direction.

Therefore, according to the exposure head 10, despite of using the light source of the broad area type, a component incident to a spatial light modulator 16 from the perpendicular direction thereto can be greatly increased, thus improving utilization factor for the laser light.

Moreover, by adjusting a light emitting area of the optical waveguide 24 to the broad area direction, an increase in size of the spatial light modulator 16 and an increase in the number of channels can be achieved while increasing the components incident onto the spatial light modulator 16 from the perpendicular direction thereto.

In the present invention, the shape of the optical waveguide 24 is not limited to the tapered shape broadening toward the traveling direction as shown in FIG. 1A. For example, the shape may be a substantially parabolic shape which is open toward the traveling direction like an optical waveguide 24*b* shown in the plan view of FIG. 1C, an intermediate shape between the tapered shape like that in FIG. 1A and the parabolic shape like that in FIG. 1C, or a combined shape thereof.

Namely, in the present invention, the optical waveguide 24 can adopt various kinds of shapes as long as they gradually broad toward the broad area direction as well as toward the traveling direction.

Note that such a light source element 12 may be properly fabricated in accordance with the number of channels of the exposure head 10, a frequency of the emitted laser light or the like by use of a well known fabrication method of BLDs or optical waveguides.

The laser light emitted from the light source element 12 (from the optical waveguide 24*a* of the optical waveguide unit 20) is sequentially made incident to the cylindrical lens 14.

The laser light emitted from the light source element 12 is diffused in a direction (hereinafter, vertical direction) perpendicular to the broad area direction and the traveling direction in the same manner as laser light emitted from an ordinary BLD. The laser light emitted from the light source element 12 is made incident to the cylindrical lens 14 and condensed to be laser light substantially collimated in the vertical direction as shown in FIG. 1B.

The laser light collimated in the cylindrical lens 14 is sequentially made incident to the spatial light modulator 16 to be a plurality of light beams (multibeams) modulated in accordance with an image to be recorded.

The spatial light modulator 16 includes a plurality of light modulation units 16*a* arrayed in the broad area direction (arrow y direction). In the present invention, as the spatial light modulator 16, various kinds of well known modulator can be adopted. For example, a liquid crystal shutter array and the like are enumerated, which includes optical shutters arrayed in the broad area direction as the light modulation units 16*a*, the optical shutters using super twisted nematic ((S)TN) liquid crystal, polymer dispersion (PD) type liquid crystal or the like. Alternatively, an optical shutter array using an acoustooptic modulator (AOM), an electrooptical modulator (EOM) or the like, a micromirror array (MMA) such as a Digital Micromirror Device™ (DMD) (manufactured by Texas Instruments Inc.) or the like can be used.

The laser light incident to the spatial light modulator 16, which is collimated in the vertical direction and broadened in the broad area direction, passes through the light modulation unit 16*a* or is obstructed at the light modulation unit 16*a* (alternatively, deflected in a different direction from that of a photosensitive material), depending on a state (ON/OFF) of the light modulation unit 16*a* at the incident position. Thus, the laser light is made to be modulated multibeams in accordance with the image to be recorded. Sequentially, for example, the multibeams form an image at the predetermined exposure position by use of the optical system described later, and then the photosensitive material is subjected to an exposure.

Namely, the exposure head 10 of the present invention can realize the multibeam image exposure by utilizing the multibeams, with the compact-sized and simple structure in which the light source of the broad area type, the optical waveguide, and the light modulator (optical shutter array) are combined. In addition, since the optical waveguide 24*a* formed in the optical waveguide unit 20 has the constitution broadening in the broad area direction toward the traveling direction as described above, the component of the light perpendicularly incident to the spatial light modulator 16 is increased, and hence it is possible to perform the image exposure with a high efficiency.

In the exposure head 10 shown in FIGS. 1A to 1C, used is the light source element 12 in which the BLD element unit 18 and the optical waveguide unit 20 are integrated with each other, which are divided by the notch 22. The present invention is not limited to such a constitution. The both units may be separate bodies.

Figure 2A:
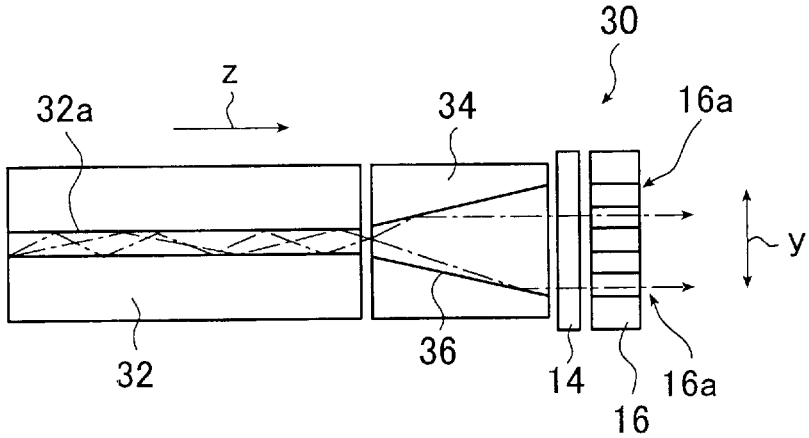
FIGS. 2A and 2B are schematic views showing another embodiment of the exposure head of the present invention.
Figure 2B:
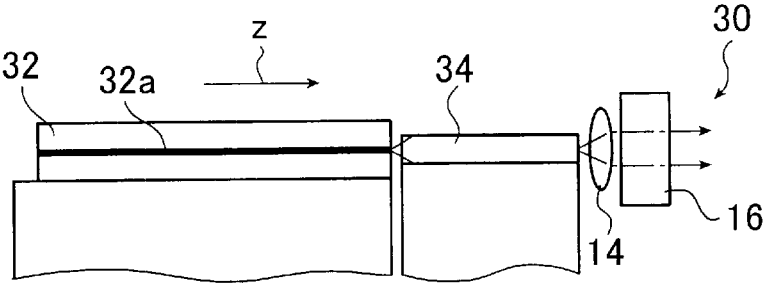

For example, an exposure head 30 shown in the schematic views of FIGS. 2A and 2B (FIG. 2A is a plan view, FIG. 2B is a side view) may be adopted, in which a light source of the broad area type such as a BLD 32 and an optical waveguide 34 are separately prepared from each other. In the exposure head 30, the laser light emitted from the BLD 32 (an active layer 32*a* thereof) is made incident to an optical waveguide 36 of the optical waveguide unit 34, and then, in the same manner as the foregoing embodiment, the light propagated and emitted from the optical waveguide 35 is collimated in the vertical direction by the cylindrical lens 14. Sequentially, the light is modulated by the spatial light modulator 16 to be multibeams modulated in accordance with the image to be recorded.

As to whether the constitution shown in FIGS. 1A to 1C or that shown in FIGS. 2A and 2B is employed, advantageous one may be selected depending on a fabricating method and the like.

In the exposure head of the present invention, the optical waveguide may be a part of the light modulator to emit the multibeams. In this constitution, the cylindrical lens 14 is disposed in downstream of light modulator (in the traveling direction).

Figure 3A:
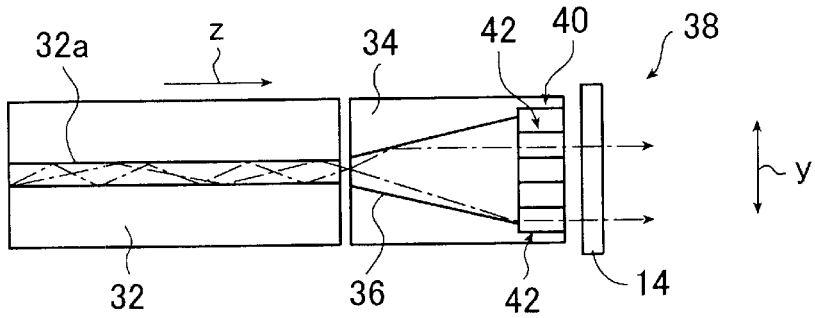
FIGS. 3A to 3D are schematic views showing still another embodiment of the exposure head of the present invention.
Figure 3B:
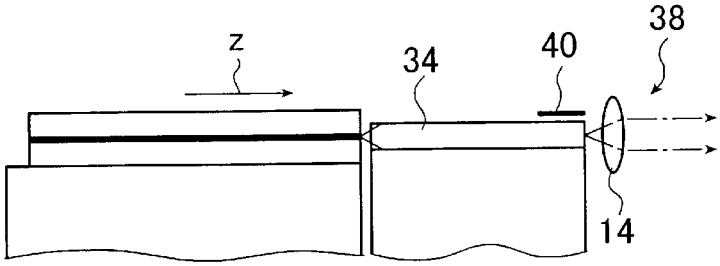
Figure 3C:
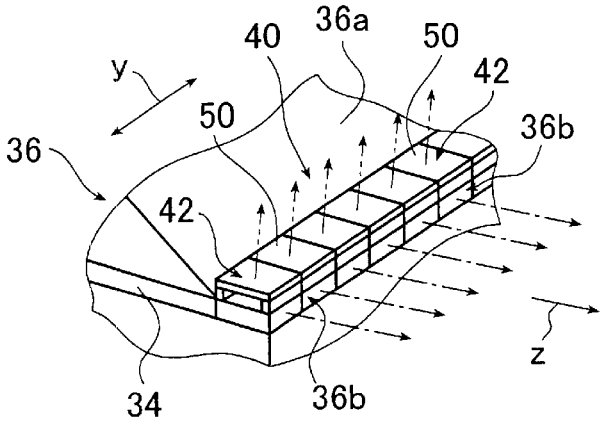
Figure 3D:
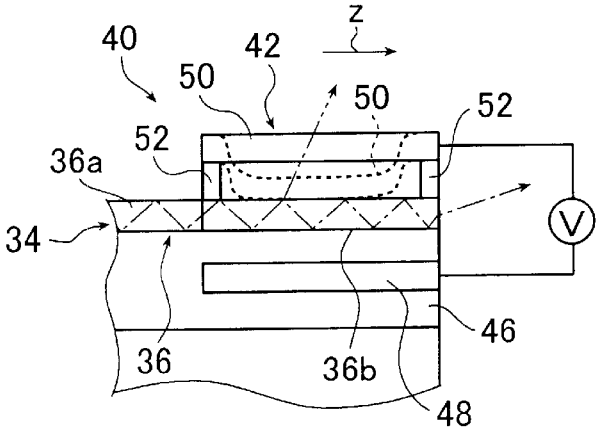

In FIGS. 3A to 3D, shown are schematic views of an embodiment of the exposure head having a light modulator 40 using an optical waveguide 36 as a part thereof in the embodiment in FIGS. 2A and 2B having the BLD 32 and the optical waveguide unit 34 separately constituted. Herein, FIG. 3A is a plan view; FIG. 3B is a side view; FIG. 3C is a partial perspective view; and FIG. 3D is a partial side view.

As shown in FIGS. 3A to 3D, in this exposure head 38, the light modulator 40 includes a part of the optical waveguide 36 and a plurality of optical modulation units 42 arrayed in the broad area direction (arrow y direction).

In the embodiment shown in the drawings, the optical waveguide 36 is divided, with respect to the traveling direction, into a common waveguide 36*a* closer to the BLD 32 and an individual waveguide 36*b* closer to an emitting end. While the common waveguide 36*a* is common to all the light modulation units 16 (all the channels), the individual waveguide 36*b* is divided in the broad area direction so as to correspond to the respective light modulation units 42 (each of channels) as shown in FIG. 3C. In the embodiment shown in the drawings, note that the optical waveguide 36 needs not to be divided so as to correspond to the respective channels.

The optical waveguide 36 is formed on a member 46, and an electrode layer 48 is formed on an area of the member 46 corresponding to the light modulation units 42.

The light modulation units 42 are formed so as to sandwich the individual waveguide 36*b* in cooperation with the electrode layer 48. Each of the light modulation units 42 is constituted so as to include a plate-shaped transparent electrode 50 made of indium tin oxide (ITO) and spacers 52. The transparent electrode 50 is disposed so as to be opposite to a boundary surface of the individual waveguide 36*b* with a space formed by the spacers 52 therebetween.

Each of the transparent electrode 50 and the electrode layer 48 are connected to a driving power source (not shown) for driving each of the light modulation units 42. The electrode layer 48, the light modulation unit 42, and the driving power source constitute a micro electronic mechanical system (MEMS).

As shown in FIG. 3D, when a driving voltage is not applied between the transparent electrode 50 and the electrode layer 48, the transparent electrode 50 is not deformed, and the transparent electrode 50 and the individual waveguide 36*b* are apart from each other.

In this state, the laser light emitted from the BLD 32 is made incident to the common waveguide 36*a* of the optical waveguide unit 34 from an incident end surface, and propagated to be emitted from the emitting end surface of the individual waveguide 36*b*. Then, the laser light is made incident to the cylindrical lens 14.

On the contrary, when the voltage is applied between the transparent electrode 50 and the electrode layer 48, as indicated by dotted lines in FIG. 3D, the transparent electrode 50 is deformed (curved) due to static electricity generated therebetween, so that the transparent electrode 50 and the boundary surface of the individual waveguide 36*b* are contacted with each other.

In this state, similarly to the foregoing, when the laser light propagated by the optical waveguide 36 is made incident to the individual waveguide 36*b*, a critical angle is varied due to the contact. Accordingly, the laser light is not reflected on the boundary surface. Therefore, as indicated by a double-dashed line in the drawing, the laser light incident to the individual waveguide 36*b* passes through the boundary surface of the individual waveguide 36*b*, and is incident to the transparent electrode 50. The laser light then passes therethrough to be emitted upwardly.

Specifically, the modulation can be performed in the following manner. The transparent electrode 50 and the individual waveguide 36*b* contact/separate with each other by turning the driving power source ON/OFF, so that the light beam emission is made ON/OFF.

Figure 4:
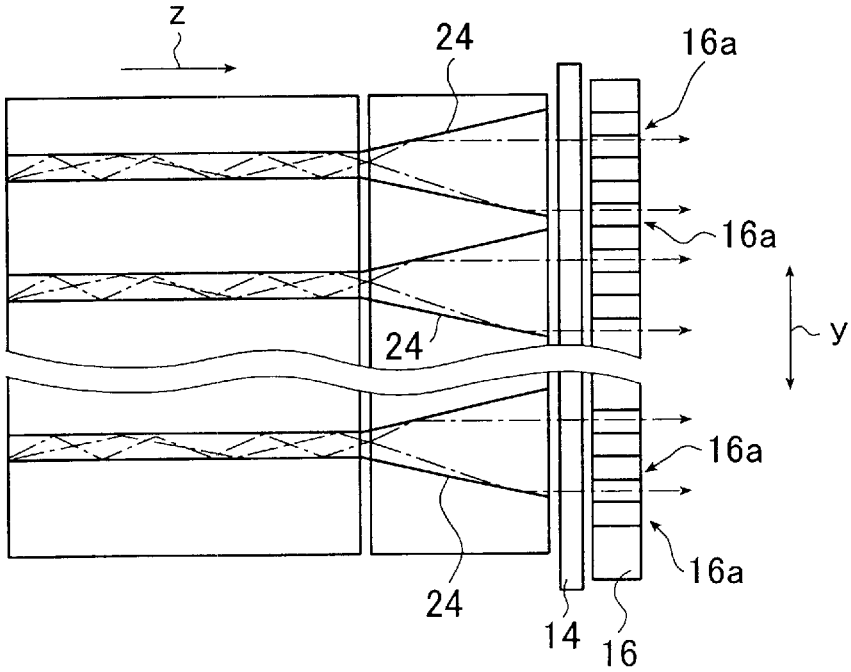
FIG. 4 is a schematic plan view showing still another embodiment of the exposure head of the present invention.

A structure of the exposure head of the present invention described above is not limited to one in which a single light source of the broad area type (emitting unit of the laser light) and a single optical waveguide are provided as shown in FIGS. 1A to 3D. As shown in FIG. 4, the exposure head may be constituted by having a plurality of light sources arrayed in the broad area direction (arrow y direction) and a plurality of optical waveguides 24 corresponding to the respective light sources.

With such a constitution, the multi-channel exposure with more channels can be coped with light beams of sufficient amounts (intensities) of light.

Such exposure head of the present invention can be used in various kinds of image recording apparatuses such as computers to plate (CTP), image setters, digital direct color proofs (DDCP), printers, and copiers.

Figure 5A:
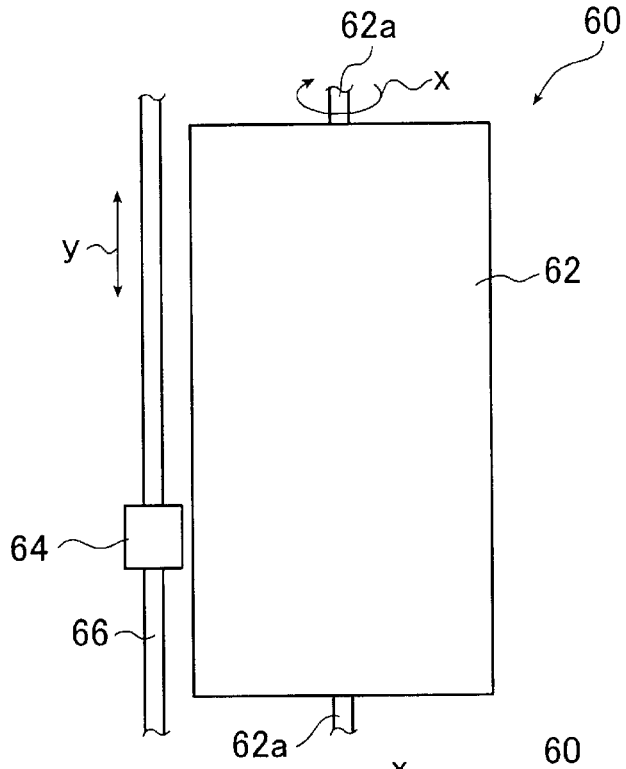
FIGS. 5A to 5D are schematic views showing an embodiment of an image recording apparatus of the present invention.
Figure 5B:
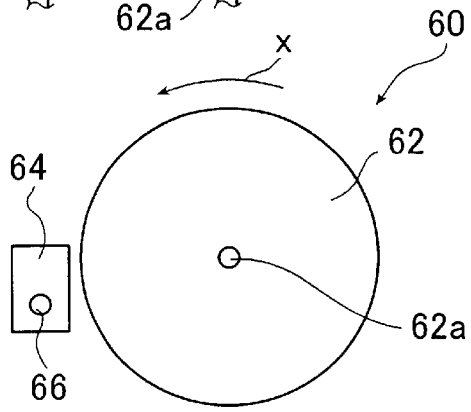
Figure 5C:
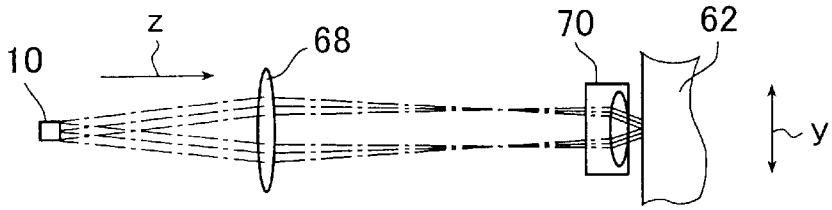
Figure 5D:
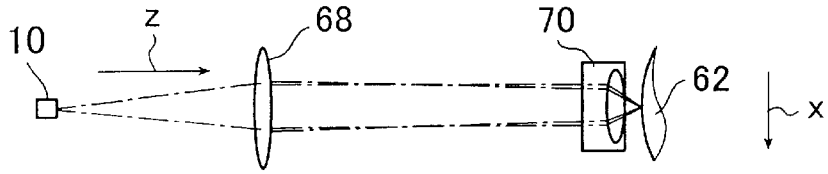

In FIGS. 5A to 5D, shown are schematic views of an image recording apparatus using the exposure head 10 of the present invention. Here, FIG. 5A is a plan view; FIG. 5B is a side view; FIG. 5C is a plan view of an optical system of the image recording apparatus; and FIG. 5D is a side view of the optical system.

An embodiment shown in FIGS. 5A to 5D is a so-called drum scanner for performing exposure with a cylindrical drum 62 wrapped with a photosensitive material on a lateral surface thereof, and is the same as an ordinary drum scanner except that the exposure head 10 of the present invention is used. Such an image recording apparatus 60 includes the cylindrical drum 62; a carriage 64 for accommodating the optical system including the exposure head 10 of the present invention; and a guide 66 for guiding the carriage 64.

The drum 62 is rotated around a rotational (drive) shaft 62*a* coincident with the drive shaft of the drum 62, for example, in the arrow x direction at a predetermined speed, while holding the photosensitive material on the lateral surface of the drum 62. A means for holding the photosensitive material by the drum 62 may be a well known one.

The carriage 64 is movably held on the guide 66 extending in an axis direction (hereinafter, referred to as a scanning direction) of the drum 62, and is moved in the scanning direction by the well known devices.

In the embodiment shown in the drawings, as shown in FIGS. 5C and 5D, the optical system accommodated in the carriage 64 includes the exposure head 10 of the present invention, a collimator lens 68 and an imaging lens 70.

The exposure head 10 is held at a predetermined position within the carriage 64 such that the scanning direction is made coincident with the broad area direction, which is the array direction of the light modulation units 16*a* (arrow y direction). The multibeams emitted from the exposure head 10 are made collimated light beams by the collimator lens 68. Sequentially, the light beams form an image on the photosensitive material held on the predetermined position, that is, on the lateral surface of the drum 62 by the imaging lens 70.

In such an image recording apparatus 60, the carriage 64 is moved in the scanning direction (auxiliary scanning) while rotating the drum 62 in the arrow x direction at the predetermined speed (main scanning), whereby the photosensitive material held on the drum 62 is two-dimensionally scanned by the carriage 64 (emitted multibeams).

At this time, the multibeams modulated in accordance with the image to be recorded are emitted from the exposure head 10 of the present invention, and the photosensitive material is subjected to exposure image-wise with the light beams, thereby recording the image on the photosensitive material. Note that the recording may be performed by a well known method in image recording using light beams such as pulse width modulation (PWM).

As described in detail, according to the present invention, multi-channel exposure with a small limitation in the amount of light can be performed by use of light beams of sufficient amounts (intensities) of light for all channels, and a cost reduction and downsizing of the apparatus can be realized.

Description has been made in detail on the exposure head and the image recording apparatus of the present invention. However, it is to be understood that the present invention is not limited to the above-described embodiments, and the various kinds of changes and modifications may be made without departing from the spirit of the present invention.

What is claimed is:

1. An exposure head comprising:

at least one light source of a broad area type;

an optical waveguide gradually broadening in a broad area direction of said at least one light source toward a traveling direction of light emitted from said at least one light source;

a member collimating the light traveling in a perpendicular direction to said broad area direction, the light being emitted from said optical waveguide; and a light modulating device including a plurality of modulation units arrayed in the broad area direction.

2. The exposure head according to claim 1, wherein said optical waveguide has one of a tapered shape and a parabolic shape.

3. The exposure head according to claim 1, wherein each of said modulation units includes a transparent conductive material disposed so as to be opposite to a boundary surface of said optical waveguide with a space therebetween and a unit for bringing said conductive material into contact with the boundary surface of said optical waveguide by use of static electricity.

4. An image recording apparatus, comprising:

an exposure head including;

at least one light source of a broad area type;

an optical waveguide gradually broadening in a broad area direction of said at least one light source toward a traveling direction of light emitted from said at least one light source;

a member collimating the light traveling in a perpendicular direction to said broad area direction, the light being emitted from said optical waveguide; and a light modulating device including a plurality of modulation units arrayed in the broad area direction;

an optical system for focusing on a predetermined position the light emitted from said exposure head; and a scanner for allowing said exposure head and a photosensitive material to move relatively, while regulating the photosensitive material at the predetermined position.

5. The image recording apparatus according to claim 4, wherein said optical waveguide has one of a tapered shape and a parabolic shape.

6. The image recording apparatus according to claim 4, wherein each of said modulation units includes a transparent conductive material disposed so as to be opposite to a boundary surface of said optical waveguide with a space therebetween and a unit for bringing said conductive material into contact with the boundary surface of said optical waveguide by use of static electricity.

* * * * *